US007252180B2

(12) United States Patent
Deplazes et al.

(10) Patent No.: US 7,252,180 B2
(45) Date of Patent: Aug. 7, 2007

(54) SITUATION-DEPENDENT REACTION IN THE CASE OF A FAULT IN THE REGION OF A DOOR OF AN ELEVATOR SYSTEM

(75) Inventors: Romeo Deplazes, Oberrüti (CH); Philipp Angst, Zug (CH)

(73) Assignee: Inventio AG, Hergiswil NW (CH)

( * ) Notice: Subject to any disclaimer, the term of this patent is extended or adjusted under 35 U.S.C. 154(b) by 608 days.

(21) Appl. No.: 10/792,060

(22) Filed: Mar. 3, 2004

(65) Prior Publication Data

US 2004/0178024 A1 Sep. 16, 2004

(30) Foreign Application Priority Data

Sep. 3, 2001 (EP) ..... 01121058

(51) Int. Cl.
*B66B 1/34* (2006.01)

(52) U.S. Cl. ..... 187/393; 187/314

(58) Field of Classification Search ..... 187/247, 187/248, 313, 314, 316, 317, 391–395, 414, 187/280

See application file for complete search history.

(56) References Cited

U.S. PATENT DOCUMENTS 4,505,360 A 3/1985 Tsuji
4,898,263 A 2/1990 Manske et al.
5,476,157 A * 12/1995 Todaro ..... 187/280
5,708,416 A * 1/1998 Zaharia et al. ..... 340/531
5,780,788 A * 7/1998 Eschenbrenner et al. ... 187/316
6,173,814 B1 1/2001 Herkel et al.
6,223,861 B1 * 5/2001 Sansevero ..... 187/316
6,550,585 B2 * 4/2003 Schoppa et al. ..... 187/391

FOREIGN PATENT DOCUMENTS

JP 05 330755 1/1993
JP 05 139634 6/1993
JP 05 170388 7/1993
WO WO 00/51929 9/2000

* cited by examiner

*Primary Examiner*—Jonathan Salata
(74) *Attorney, Agent, or Firm*—Fraser Clemens; Martin & Miller LLC; William J. Clemens

(57) ABSTRACT

An elevator system includes an elevator car having a car door, a drive unit for moving the elevator car along an elevator shaft wall provided with shaft doors and a controller for controlling movement of the elevator car along the elevator shaft wall. A separate fault detecting device is mounted in a region of each of the shaft doors and in a region of the car door for generating fault information to controller. A status detecting unit generates to the controller status information about a position and a speed of the elevator car. In the case of a fault in the region of one of the shaft doors, the controller permits operation of the elevator car between those floors that can be reached by the elevator car without having to pass the floor at the shaft door where the fault has occurred.

20 Claims, 3 Drawing Sheets

SITUATION-DEPENDENT REACTION IN THE CASE OF A FAULT IN THE REGION OF A DOOR OF AN ELEVATOR SYSTEM

BACKGROUND OF THE INVENTION

The present invention relates to an elevator system and an elevator controller. The elevator system comprises an elevator car that is moved by a drive unit along an elevator shaft wall provided with shaft doors, wherein this shaft wall can be part of an elevator shaft closed all around by shaft walls or constructed to be wholly or partly open at one or more sides.

There is known from the U.S. Pat. No. 4,898,263 a monitoring device for elevator systems which generates on each occasion in accordance with a self-diagnostic process a specific reaction for concrete fault cases in order, in particular, to reduce the speed of an elevator car or in order to stop it. It is also known, for example from the international patent specification WO 00/51929, to use in systems of that kind different redundantly operating sensors, changeover switches and microprocessors as well as a data bus. Since such systems are quite complex, they have proved to be relatively complicated and costly.

SUMMARY OF THE INVENTION

It is therefore the object of the present invention to create an elevator system that ensures a higher degree of operational reliability and functionality than prior art systems with comparatively little cost.

The present invention concerns an elevator system with: an elevator car having a car door; a drive unit connected to the elevator car for moving the elevator car along an elevator shaft wall provided with shaft doors; a controller connected to the drive unit for controlling movement of the elevator car along the elevator shaft wall; a detecting means mounted in at least one of a region of each of the shaft doors and in a region of the car door for generating fault information, the detecting means being connected to the controller for generating to the controller the fault information; and a status detecting unit connected to the controller for generating to the controller status information about a position and a speed of the elevator car. In the case of a fault in the region of one of the shaft doors, the controller permits operation of the elevator car between those floors that can be reached by the elevator car without having to pass the floor at the shaft door where the fault has occurred.

The fault information can include a state of an incorrectly closed one of the shaft doors and the car door, the controller responding to the fault information representing an insubstantial gap by placing a service call without interrupting operation of the elevator system and representing a substantial gap by stopping operation of the elevator system and placing a service call. The controller further responds to a presence of a fault in the region of one of the shaft doors by moving the elevator car behind the one shaft door and performing a recovery attempt by opening and closing the one shaft door through automatic opening and closing of the car door.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
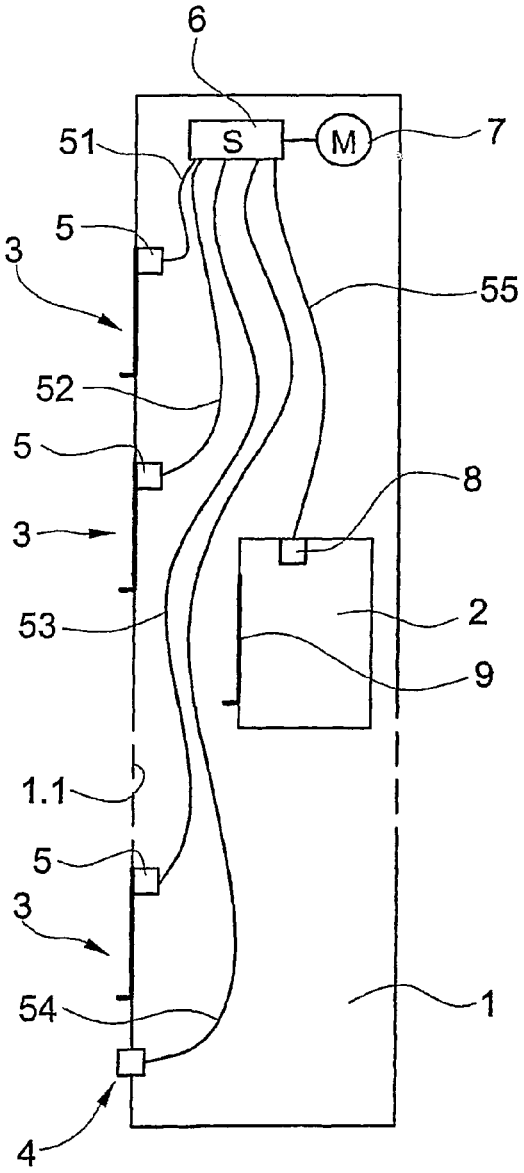
FIG. 1 is a schematic illustration of an elevator shaft with a controller, which is connected by way of individual lines with different elements of the elevator system.

A first elevator system according to the present invention is shown in FIG. 1. The illustrated elevator system comprises an elevator car 2 with at least one car door 9 and a drive unit 7 for moving the elevator car 2 along an elevator shaft wall 1.1, which is provided with shaft doors 3, of an elevator shaft 1. A controller 6 is provided for controlling the drive unit 7. On each floor there is, in the region of the shaft door 3, a detecting means 5 which is connected with the controller 6 by way of an associated one of individual lines 51, 52 and 53. In addition, such detecting means 8 is mounted at the elevator car 2, preferably in the region of the car door 9. The detecting means 5 make available fault information to the controller 6 by way of the lines 51, 52 and 53 and the detecting means 8 makes available fault information to the controller 6 by way of a line 55. In the case of a fault in the region of one of the shaft doors 3 or the car door 9 the controller 6 has available, for example, fault information about the kind of fault and about the position (for example, floor 2) of the fault. The elevator system according to the present invention additionally comprises a status detecting unit (not shown in FIG. 1), which can detect the instantaneous position and the speed of the elevator car 2. The status detecting unit is connected with the controller 6 by way of a line (not shown in FIG. 1). Through this line the controller 6 has available information about the instantaneous position and about the speed of the elevator car 2. Preferably, the status detecting unit also makes available information with respect to the direction of movement of the elevator car 2.

According to the present invention the controller 6 determines, with consideration of the kind of fault, the position of the fault and the status information, a situation-dependent, safe reaction. Thus, a certain residual functionality of the elevator car 2 is guaranteed notwithstanding the fault. The general functionality of the elevator system can thereby be enhanced.

As shown in FIG. 1, further detecting means 4 can be present at the shaft 1, which is constructed to be open or closed, the further detecting means being connected with the controller 6 by way of a line 54. Through such further detecting means 4 there can be made available to the controller 6 additional information which can find consideration in the determination of a suitable reaction.

The detecting means 5 are not part of a conventional safety circuit, since such a safety circuit would be directly interrupted in the case of occurrence of a fault in the region of the elevator car 2. A situation-dependent, safe reaction would then not be possible in such a case.

The term "detecting means" comprises inter alia sensors, switches (for example, magnetic switches), changeover switches, door contacts, light barriers, movement and contact sensors, proximity sensors, relays and other elements which can be used in order to monitor the shaft doors, the environment of the shaft doors, the car door or doors and the elevator shaft, to check the state thereof and to recognize faults of any kind in the shaft door region and/or in the car door region. In particular, the detecting means can be safety-relevant means coming into use in the systems according to the invention. The detecting means can also consist of a combination of several of the stated elements.

In the form of embodiment shown in FIG. 1, the detecting means 5 and 8 are directly connected with the controller by way of the lines 51 to 53 and 55 respectively. The detecting means 5 and 8 can be interrogated from the controller 6 or the detecting means 5 and 8 automatically transmit information to the controller 6.

Figure 2:
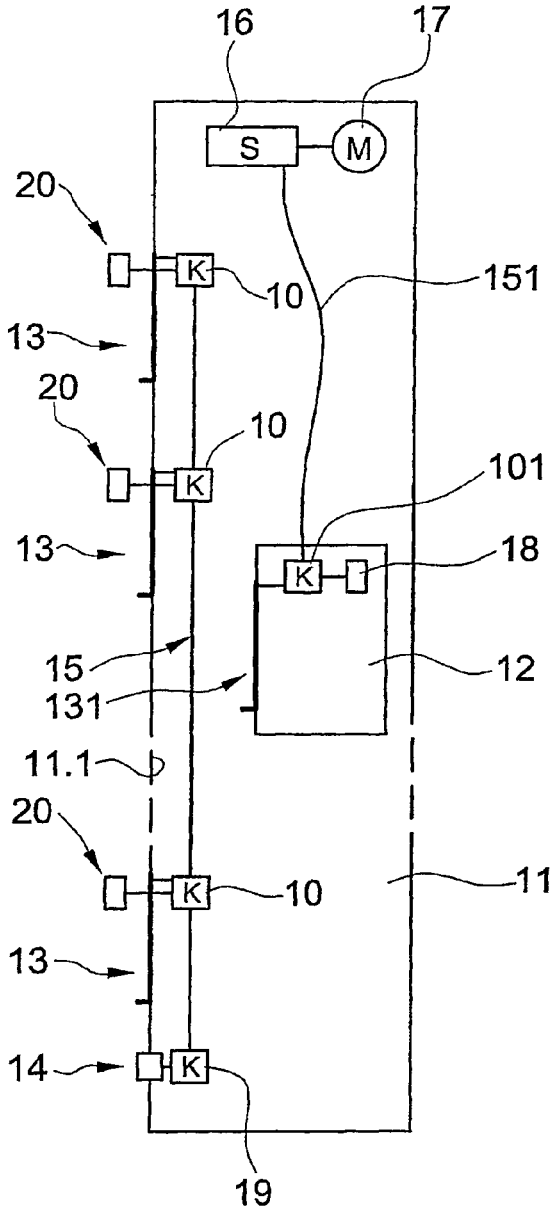
FIG. 2 is a schematic illustration of an elevator shaft with a controller, with which different elements of the elevator system are connected by way of at least one bus.

A further or alternate elevator system according to the present invention is shown in FIG. 2. The illustrated elevator system comprises an elevator car 12 with at least one car door 131 and a drive unit 17 for moving the elevator car 12 along an elevator shaft wall 11.1, which is provided with shaft doors 13, of an elevator shaft 11. A controller 16 for controlling the drive unit 17 is provided. On each floor there is, in the region of the shaft doors 13, detecting means 20 all of which are connected with the controller 16 by way of a bus 15. The detecting means 20 make fault information available to the controller 16 by way of associated floor nodes 10 and the bus 15. Detecting means 18 is mounted in or at the elevator car 12 in the region of the car door 131. The detecting means 18 is preferably connected with the controller 16 by way of a node 101 and a bus 151. The illustrated elevator system moreover comprises a status detecting unit (not shown in FIG. 2) which can detect the instantaneous position and the speed of the elevator car 12. In addition, the status detecting unit is preferably connected with the controller 16 by way of a node and a bus (not shown in FIG. 2). The controller 16 has available information about the instantaneous position and about the speed of the elevator car 12 via the bus which is either a separate bus associated only with the status detecting unit or in which it is the bus 151 used by the detecting means 18. In the case of a fault in the region of one of the shaft doors 13 or in the region of the car door 131 the controller 16 thus has available, for example, fault information about the kind of fault and about the position of the fault.

The status detecting unit preferably also makes available information with respect to the direction of movement of the elevator car 12.

As shown in FIG. 2, further detecting means 14 can be present at the shaft 11, which further detecting means is connected by way of a node 19 and the bus 15 with the controller 16. Through such further detecting means 14 there can be made available to the controller 16 additional information which can find consideration in the determination of a suitable reaction.

The fault information has to be made securely available to the control unit 6, 16 in order to be able to ensure that the entire elevator system is operationally safe in every situation and under all circumstances. For this purpose the fault information can be transmitted, for example, safely by way of the bus. For this purpose there are the most diverse possibilities of realization, which are not described in detail here since these are sufficiently known to the expert. Transmission errors can be prevented by suitable measures or, if these cannot be avoided, transmission errors must at least be able to be detected and thus also able to be eliminated.

In order to enable a secure transmission of the fault information, various concepts, which are known per se, from communications technology can be used. In an advantageous form of embodiment the bus 15 and/or the bus 151 is a so-termed safety bus as is also used in other elevator systems.

As described in connection with FIGS. 1 and 2, a status detecting unit is preferably located in or at the elevator car 2 or 12. The status detecting unit is preferably connected with the controller 16 by way of the car bus (for example, the car bus 151). A safety bus is usually used as the car bus.

An elevator system according to the present invention preferably comprises the floor nodes 10 which are designed in such a manner that signals from the detecting means 20 of the respective floor are provided at inputs of the floor node 10, wherein the floor nodes 10 process these signals in order to be able to make corresponding fault information available to the controller 16. The same also applies to the car node 101, which obtains signals from the detecting means 18 and processes these in order to be able to make corresponding fault information available to the controller 16. The floor nodes 10 and the car node 10 can also be equipped with a certain degree of intelligence, for example in the form of a software-controlled processor, in order to undertake local decisions and possibly even to be able to take over certain control functions.

A further form of embodiment of an elevator system is distinguished by the fact that the detecting means 20 or 18 and/or the status detecting unit is or are connected with the controller 16 by way of a safety bus.

Ideally, a permanent detection of the status of the elevator car 2 or 12 is carried out. In the case of a digital embodiment the detecting means and/or the status detecting unit is or are frequently sampled in order to be able to ensure a quasi-continuous information and status detection. The controller 6 or 16 is thus informed at all times about the position, speed and, depending on the respective form of embodiment, also about the direction of travel of the elevator car 2 or 12. By contrast, in the case of the monitoring device described in U.S. Pat. No. 4,898,263 there are provided, at the shaft, means which co-operate with means at the elevator car as soon as the car approaches a floor. Thus, a permanent or quasi-continuous detection is not present according to U.S. Pat. No. 4,898,263.

A further elevator system is, according to the present invention, so designed that it is separately ascertainable by the detecting means 5 or 20 whether a gap formed by an incorrectly closed shaft door 3 or 13 is substantial or insubstantial. If an insubstantial gap at a shaft door is detected then, by way of example, one of the six following situation-dependent reactions can be triggered:

Movement of the elevator car to behind the shaft door concerned. Opening and closing of the shaft door in that the car door is opened and closed. Checking whether the insubstantial gap continues to exist. If so, trigger service call.

Checking whether the information delivered by the detecting means in the region of the shaft door concerned is plausible/correct with respect to the presence of an insubstantial gap. This can be carried out, for example, in that redundantly executed sensors are interrogated in the detecting means. If the supplied information is plausible/correct, the elevator car can be moved to behind the shaft door concerned, the shaft door opened and closed in that the car door is opened and closed, and it can be checked whether the insubstantial gap continues to exist. If so, a service call is triggered.

Trigger a service call independently of what results from checking the information made available or independently of whether such checking was even carried out.

Continuing to deal with the traffic in the region in which all shaft doors are in order (denoted as permitted zone). If travel outside the permitted zone is desired, in which the affected shaft door would have to be passed, giving an acoustic communication that the desired floor cannot be traveled to for the moment. Wait for a new floor selection by passengers or let passengers disembark and trigger a service call. The floor in which the fault was detected in the region of the shaft door is termed risk zone or non-permitted zone, wherein in the case of an insubstantial gap no direct risk is actually present.

Travel to the desired floor if in that case the affected shaft door or the non-permitted zone do not have to be passed. Otherwise, travel to the next possible floor, let passengers disembark and place a service call.

Place service call and continue to travel normally.

If a substantial gap is present at one of the shaft doors, then, for example, one or more of the following situation-dependent reactions can be triggered:

Maintenance of operation of the elevator car, preferably at reduced speed, so that the elevator car can be moved in controlled manner to one of the next floors without in that case having to travel through the non-permitted zone.

Trigger an emergency call in the case of elevator stoppage or place a service call if the elevator can still be operated.

If the elevator car is located at the floor with the shaft door fault, then the shaft door is opened and closed again by opening and closing the car door. If the fault continues to be present, a service call is placed. The elevator car is not placed in motion. The passengers are required to disembark and optionally required to use a neighboring elevator car.

The controller of the elevator prevents persons from being placed at risk, in that the elevator car is moved directly below the faulty shaft door and kept there. Thus, in certain circumstances a person can be prevented from entirely opening the shaft door and falling into the elevator shaft. If the gap is large, it can also happen that a person forces through the gap. In this case, too, falling into the elevator shaft is prevented.

Another, secondary reaction is: the elevator car travels to the affected floor behind the affected shaft door, for example in creeping motion and without passengers. The passengers have previously disembarked at an unaffected floor.

The controller can attempt to close the faulty shaft door by repeated actuation. If this attempt succeeds, the elevator system can be transferred back into the normal operational state.

The elevator is usually shut down if the substantial gap continues to exist.

In the case of the situation-dependent reactions, different reactions can be triggered depending on whether the elevator car is at rest or is moving. If in the case of an elevator car at rest a problem is discovered in the region of the shaft door at the floor of which the elevator car is just present, then there is not even onward movement, but the car door is, together with the shaft door, opened again and then once more closed in order to attempt to eliminate the fault.

In a further form of embodiment detecting means can be provided by which it can be established whether the car door 9 or 131 has a substantial or insubstantial gap. If an insubstantial gap at a car door is detected, then, for example, one of the following situation-dependent reactions can be triggered:

Maintenance of the operation of the elevator car so that the elevator car can continue to be moved. Opening and closing of the car door at the next stop. Checking whether the insubstantial gap continues to exist. If so, trigger service call.

Check whether the information, which is delivered by the detecting means in the region of the car door, with respect to the presence of an insubstantial gap is plausible/correct. This can be carried out, for example, in that redundantly executed sensors in the detecting means are interrogated. If the supplied information is plausible/correct, the car door is opened and closed in order to check whether the insubstantial gap continues to exist. If so, trigger a service call.

Trigger the service call independently of the result of checking of the information made available or independently of whether such a check was even undertaken.

Restricted travel operation at reduced speed until the fault is eliminated.

Place a service call and continue to travel normally.

If a substantial gap is present at the car door, then, for example, the following situation-dependent reaction can be triggered:

Maintenance of operation of the elevator car, preferably at reduced speed, so that the elevator car can be moved in controlled manner to one of the next floors.

Trigger an emergency call.

If the elevator car is at rest, then the car door is opened and closed again. If the fault continues to exist, a service call is placed. The elevator car is not placed in motion. The passengers are required to disembark and optionally required to use a neighboring elevator car.

Normally, the elevator is shut down if the substantial gap continues to exist.

Different reactions can be triggered depending on whether the elevator car is at rest or whether this moves.

In the case of a elevator system according to the present invention the situation-dependent reaction can, for example in the case of a fault in the region of one of the shaft doors, allow operation of the elevator car only between the permitted floors in order to prevent travel to or passing of the floor at the shaft door of which the fault has occurred.

In the case of a further elevator system according to the present invention the state of an incorrectly closed shaft door or car door is automatically checked in that either additionally present sensors are interrogated or in that it is attempted to eliminate the fault by renewed opening and closing.

Figure 4:
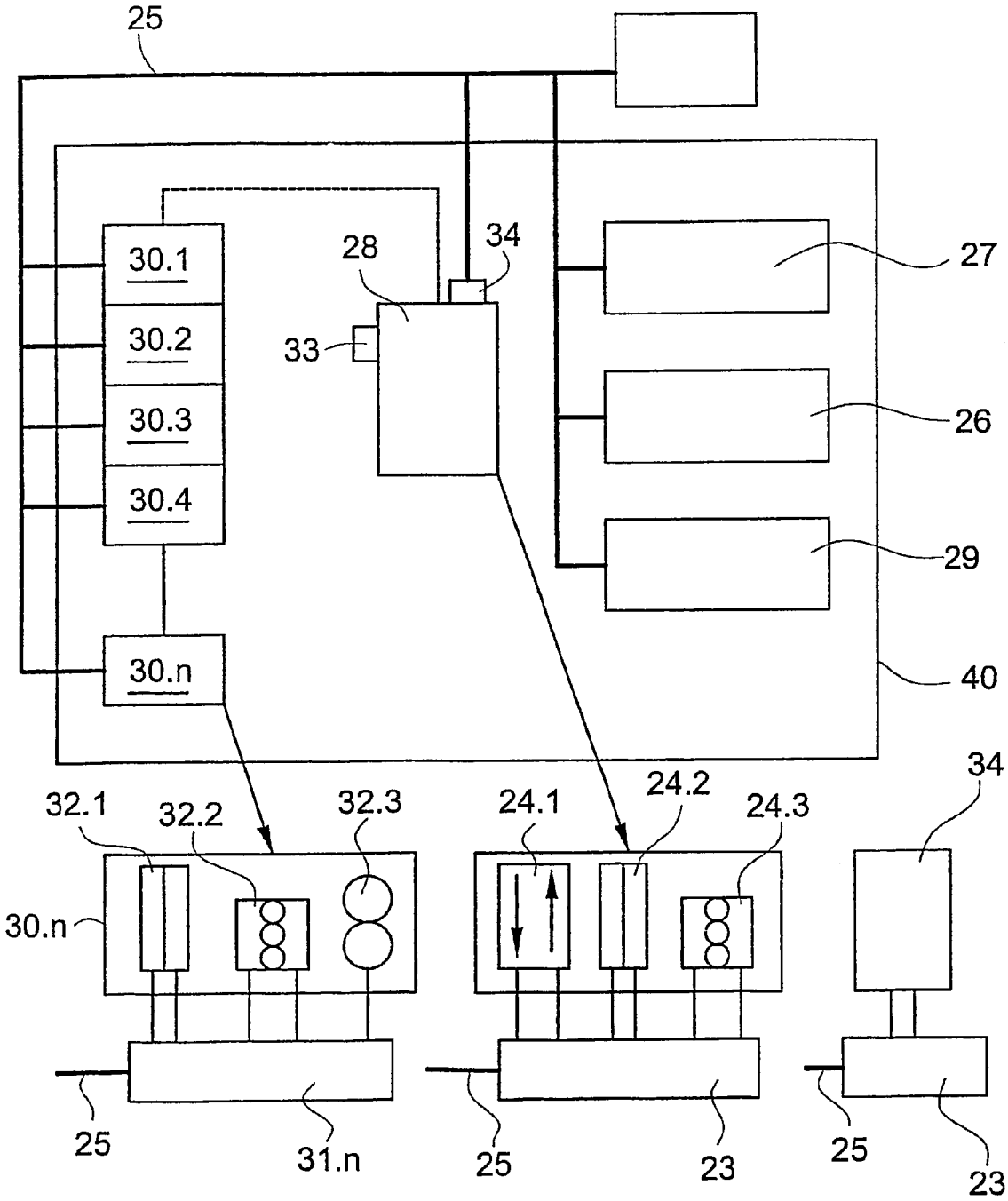
FIG. 4 is a block circuit diagram of an elevator controller with several modules for such an elevator system.

The above-described elevator systems can comprise an elevator controller such as described in the following. An example of such an elevator controller 26 as part of an elevator system 40 is shown in FIG. 4. Such an elevator controller 26 serves for controlling a drive unit 27, which moves an elevator car 28 with at least one car door along an elevator shaft wall of an elevator shaft with several floors and shaft doors. For this purpose, the elevator control 26 comprises the following elements/components:

Detecting means 30.1 through **30.*n* which are mounted in the regions of the shaft doors and are connected with the elevator controller 26 so that the elevator controller 26** has available fault information about the state of the shaft doors;

Additional detecting means 34 at the elevator car 28 and/or at the car door or doors (constructed to be the same as or similar to the detecting means in the region of the shaft doors). The detecting means 34 is connected with the elevator controller 26 so that the elevator controller 26 has available fault information about the state of the car door or doors:

A status detecting unit 33 (preferably mounted in or at the elevator car 28), which is connected with the elevator controller 26 so that the elevator controller 26 has available status information about the position and the speed of the elevator car 28. The detecting means 30.1 through **30.*n* and 28 transmit, in the case of a fault in the region of one of the shaft doors or the car door or doors, to the elevator controller 26** fault information about the kind of fault and position of the fault.

As schematically illustrated in FIG. 4, each of the detecting means 30.1 through **30.*n* has an interface 31.*n* which produces a connection/linking with a bus 25. In the illustrated example there is concerned a bus 25 disposed to be star-shaped. In the example of the detecting means 30.*n* it is shown that such a detecting means 30.*n* can comprise several elements/components 32.1 through 32.3**.

The detecting means 34 is connected by way of an interface 23 with the bus 25. The detecting means 34 makes fault information available to the elevator controller 26 by way of the bus 25. In addition to the detecting means 34, the elevator car 28 comprises indicating elements 24.1 which indicate the direction of travel of the car 28, indicating elements 24.3 which indicate the instantaneous floor and control elements 24.2. These elements 24.1 through 24.3 are also linked with the bus 25 by way of the interface 23.

The status detecting unit 33 can be connected with the bus 25 by way of an interface (not shown). The status detecting unit 33 can comprise the most diverse elements and sensors serving for detection of the car speed, position and, optionally, direction of travel.

The communication and, in particular, the transmission safety between the individual components of the elevator system 40 can be regulated and organized by, for example, a special communications unit 29. However, the communications unit 29 can also serve the purpose of making possible communication with other systems. For example, there can be placed by way of the communications unit 29 a service call which is then passed on by way of an external network.

The communication within the system 40 can, however, also be handled by way of a communications module integrated in the controller 26.

The elevator controller 26 can, with consideration of the kind of fault, the position of the fault and the status information, trigger a situation-dependent, safe reaction in order to guarantee residual functionality of the elevator car notwithstanding the fault.

The elevator system according to the present invention functions in the manner that in the case of a fault in the region of one of the shaft doors or the car door or doors at least one of the situation-dependent, safe reactions described further above is triggered.

Faults of an elevator system arise in part in the region of the shaft doors. In particular, the shaft doors 3 or 13 themselves, but also the door contacts of the shaft doors 3 and 13, are susceptible to fault. Through the intelligence system reactions according to the present invention, the functionality of the entire elevator system can be increased so that in the case of certain faults in the region of the shaft doors persons are prevented from remaining trapped in the elevator car 2 or 12.

The elevator system can comprise the detecting means 5, 20, 30.1 through **30.*n* in order to establish whether a gap formed by an incorrectly closed shaft door 3 or 13 is "substantial" or "insubstantial". A gap can be considered "substantial" and thus placing safety at risk if it is, for example, larger than ten millimeters. If the gap is not substantial and thus does not place safety at risk, then—as described further above—other reactions can be triggered. On the next stop at the affected floor the state of the shaft door 3 or 13 can then be checked by opening and closing the shaft door 3 or 13**. A fault of that kind can frequently be eliminated by such an opening and closing of the shaft door.

If the gap continues to exist after opening and closing the shaft door 3 or 13 then a service call can be triggered. The elevator can in certain circumstances continue to be operated, wherein possibly there is travel at reduced speed. This applies particularly when the gap was classified by the detecting means 5, 20, 30.1 through **30.*n*** as "insubstantial".

If it is established that the gap is "substantial" even before departure of the elevator car 2 or 12, then the shaft door 3 or 13 is opened at least once and closed again in that the elevator car is moved behind the shaft door and the car door is opened and closed. If the "substantial" gap should not thereby be eliminated, the elevator car is preferably not placed in motion. An announcement can be carried out or a display can light up in order to require the passengers to leave the elevator car 2, 12, 28.

Opened or not fully closed car doors are discussed in the following. As a starting position for the flow chart according to FIG. 3 there is now considered at A a sudden report of the detecting means 8, 18 or 34 which reads: "car door open". A virtual decision stage represented by a discriminator (decision block) D0 then sets the question: is the elevator car 2, 12 or 28 traveling? As described in the introduction, the controller 6, 16 or 26 has status information available which, inter alia, allows a statement about the instantaneous position and speed of the elevator car 2, 12 or 28.

If the elevator car 2, 12 or 28 is still traveling (answer: yes), a situation-dependent reaction R0 is triggered, wherein the controller 6, 16 or 26 initiates and executes a rapid stopping process. In addition, independently of whether the answer in the decision stage D0 was yes or no it can be checked, for example by a reaction R1 within the scope of a plausibility test, whether the car door 3 or 13 is actually open. This test can be undertaken by the door drive, wherein the detecting means 8, 18, 34 check whether the car door 3 or 13 could be successfully closed. Additional statements can be made if at the same time consideration is given to information delivered by the detecting means 5, 20, 30.1 through **30.*n* in the region of the shaft door, at the floor of which the elevator car 2, 12 or 28** is just located.

Thereafter, in the illustrated example a decision stage D1 queries by way of the detecting means 8, 18, 34 whether the car door 3 or 13 is open. If the answer to the decision stage D1 reads no, then the presumption is applicable that the car door 3 or 13 may be closed, but the closing contact of the car door 3 or 13 may be open. In this case the car 2, 12 or 28 is moved, by a further reaction R2, at reduced speed to the next floor. Since at the start the answer was no (car not stationary) at the decision stage D0, in every case the car door 3 or 13 is opened (possibly the car door 3 or 13 is opened only a gap wide) by a reaction R3 and a repeated actuation of the car door 3 or 13 initiated in order to attempt to eliminate the fault in this manner. The further query whether the closing contact is in order can be decided by a next decision stage D2: if the closing contact is in order, then the elevator system is transferred to normal operation by a reaction R4. Depending on the respective form of embodiment there can be sent, together with a service call, a fault report to a service center. If the closing contact does not appear to be in order, then the elevator system is taken out of operation by a further reaction R5 and a corresponding report goes to the service center.

If at the decision stage D1 the answer was "the car door is open", then it is attempted as reaction R10 to close the car door 3 or 13. Thereafter it is again queried in D20 whether the car door 3 or 13 is open: if no, normal operation is produced again by a reaction R20 and at the same time a report to the service center is triggered; if yes, a plausibility test is carried out by a reaction R21. Thereafter, it is again queried by a further decision stage D30 whether the car door 3 or 13 is open. If yes, there is issued as reaction R31, for example, a warning report "door is open" and the plausibility test is repeated.

A subsequent query at a decision stage D40 causes as a situation-dependent reaction R41, if the car door 3 or 13 is open, the elevator system to be taken out of operation and an emergency call to a service center is triggered. If, thereagainst, the response to the decision stage D40 was that the car door 3 or 13 is shut, then normal operation is switched on and a report to the service center is triggered. If, therefore, there is read at the decision stage D30 or D40 the answer that the car door 3 or 13 is not open then this has to be interpreted that the car door 3 or 13 is indeed closed, but the closing contact is open; this corresponds with the answer of the decision stage D1 and the "no" report of the decision stage D30 or D40 is executed as the reaction R3.

If, however, the answer: "the elevator car is stationary" was at the decision stage D0, then the reactions R21 and R31 can be eliminated in such a manner that ultimately only one of the four situation-dependent reactions R20, R41, R4 or R5 is executed.

Figure 3:
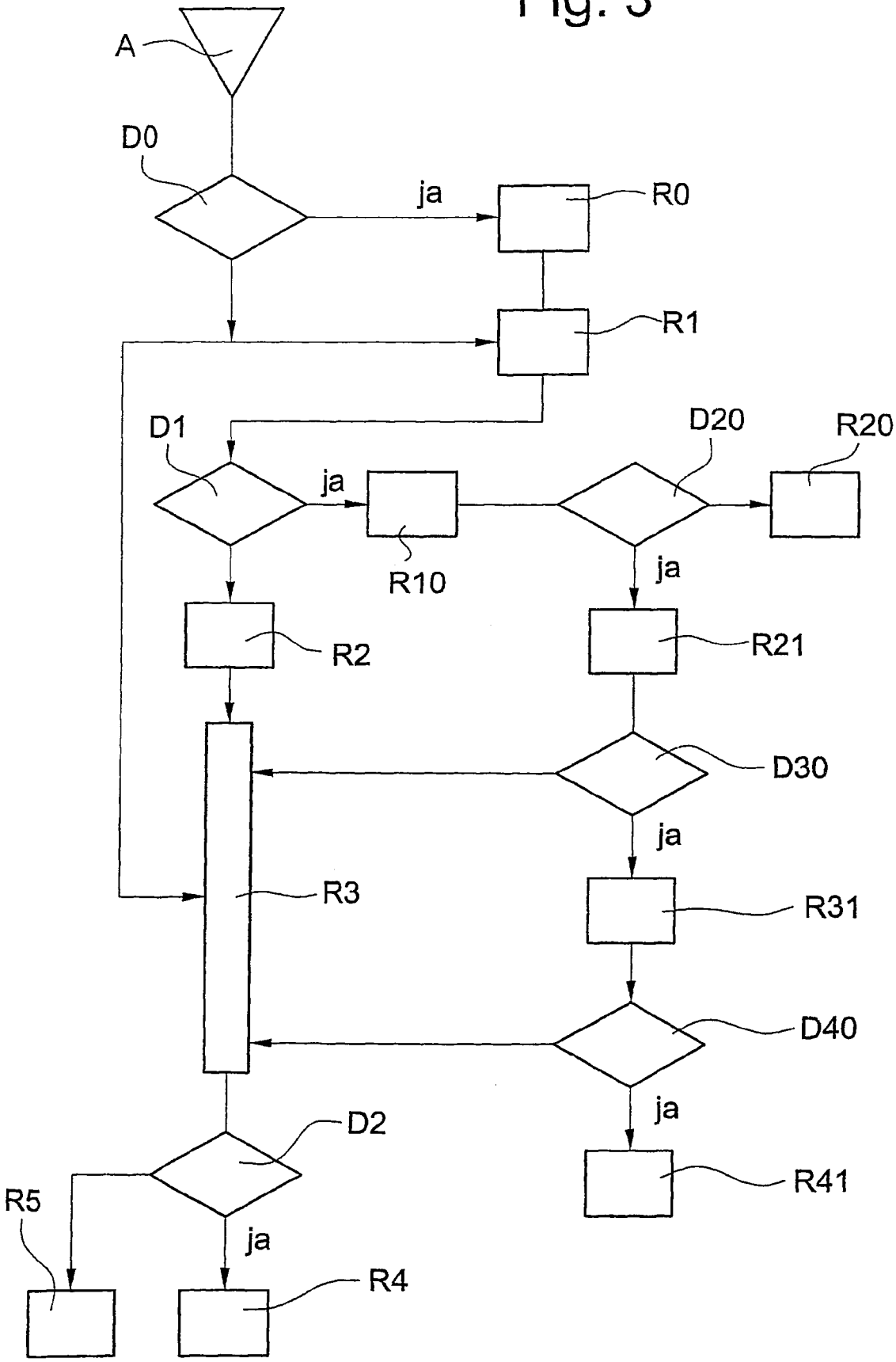
FIG. 3 is a flow chart for explanation of the mode of operation of an embodiment of the elevator system according to the present invention.

As soon as the elevator system establishes that a shaft door is open, reactions can be triggered in similar manner as shown in FIG. 3, wherein, however, it is to be noted that shaft doors are passive doors which can be opened and closed only by the car door or by a special tool. In order to be able to automatically open and close a shaft door the elevator car thus must first be moved behind the corresponding shaft door. If a shaft door was closed once by the car door and locked by the lock of the shaft door it is rather improbable that faults or problems with the shaft door come about after departure from the corresponding floor by the elevator car.

Poorly functioning shaft door and/or car door or doors:

The shaft doors 3 or 13 and/or car door or doors 9, 113 can be tested with respect to the functionality thereof by opening and closing. For that purpose, the elevator system can systematically check by the detecting means 5, 20 or 30.1 through **30.*n* or by the detecting means 8, 18, 34, for example, the force necessary for the opening or closing. Since the shaft doors are passive and moved by the car door or doors, it is more important that the detecting means 8, 18, 34 monitor the car door or doors. The car door drive can also be monitored in order to establish, for example, whether an increased force is necessary in order to move the car door and the shaft door in common. If, for example, the detecting means 8, 18, 34 establishes that a higher force is necessary at a specific floor than in other floors then it can be concluded therefrom that the shaft door 3 or 13** at the floor concerned provides problems. Then one or more of the following reactions can, for example, be triggered as a situation-dependent reaction:

place a service call;

define the corresponding floor as a non-permitted zone;

stop operation of the elevator system.

The value of the force required for opening or closing can also be stored from time to time. Thus, a comparison of actual forces with the previously required forces is possible. In addition, problems in the region of the shaft or car doors can be recognized by this extension.

Dealing with further faults:

The elevator system can equally be designed so that a situation-dependent reaction is triggered even in the case of occurrence of other kinds of faults. In that case, the controller preferably distinguishes between known and unknown kinds of faults. If a known type of fault is present then the controller can cause a situation-dependent reaction by way of a table entry, a decision tree of similar means. In order to design the elevator system to be as safe as possible, on occurrence of an unknown kind of fault an immediate stopping of the travel operation should be carried out. An emergency call can possibly then be placed.

In the case of monitoring of other devices or elements, for example in the case of monitoring the closed settings of the maintenance and emergency doors or maintenance panels or in the case of monitoring of the locking of the emergency panels and emergency force-open doors of the elevator car, different situation-dependent reactions are possible. Example of a situation-dependent reaction: rapid, drive-regulated stopping at the next floor and allowing disembarkation of passengers.

An elevator system according to the present invention can enable bypassing, in terms of software, of individual sensors and/or contacts or all detecting means in order to be able to produce, for example in certain service situations, states which would normally be precluded by the controller according to the invention. It is important that such a bypassing in terms of software is automatically reset after a certain time so that a possible overlooking cannot lead to a risk situation.

According to a special form of embodiment of the present invention the elevator controller 26 comprises a software-controlled component which evaluates the signals arriving by way of the bus 25 and triggers a reaction corresponding with the situation. For that purpose there can be operation with tables, decision trees or other similar means.

In order to be able to recognize the status of an elevator system and thus also imminent risks, dispersed sensors are preferably used as detecting means, wherein in each instance two or more sensors could be provided for mutual checking or mutual support. The actuators, control blocks, drive elements or setting elements serving for carrying out the reactions can be indirectly observed by way of the sensors. They are preferably designed in such a manner that in the case of fault they go over into the safe state (fail safe) so as not to negatively influence the elevator system.

The floor nodes and/or the elevator controller can be provided with two or more processors in order, through this redundancy, to increase the safety of the entire system. The floor nodes and/or the elevator controller can be self-checking in order to form a trustworthy overall unit. In a given case, a triple modular redundancy (TMR: Triple Modular Redundancy) can also be used.

In another form of embodiment the functionality of the elevator control can preferably be distributed to two or more parallel operating node computers, wherein the control is executed as software tasks in the node computers.

The different elevator systems according to the present invention prove particularly advantageous with respect to their high operational security, functionality and reliability, particularly since faults, failures, operating time faults, unexpected actions and undiscovered development errors can be recognized and remedied in good time.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An elevator system comprising:

an elevator car having a car door;

a drive unit connected to said elevator car for moving said elevator car along an elevator shaft wall provided with shaft doors;

a controller connected to said drive unit for controlling movement of said elevator car along the elevator shaft wall;

a detecting means mounted in at least one of a region of each of the shaft doors and in a region of said car door for generating fault information, said detecting means being connected to said controller for generating to said controller said fault information; and a status detecting unit connected to said controller for generating to said controller status information about a position and a speed of said elevator car whereby, in case of a fault in the region of one of the shaft doors, said controller permits operation of said elevator car between those floors which can be reached by said elevator car without having to pass the floor at the shaft door where the fault has occurred.

2. The elevator system according to claim 1 wherein said controller responds to said fault information representing a fault by placing a service call.

3. The elevator system according to claim 1 including a node connected to said detecting means and a bus connecting said node with said controller.

4. The elevator system according to claim 3 wherein a signal representing a detected fault generated from said detecting means is processed by said node to generate said fault information.

5. The elevator system according to claim 1 including a safety bus connecting said controller to at least one of said detecting means and said status detecting unit.

6. The elevator system according to claim 1 wherein said fault information includes a state of an incorrectly closed one of the shaft doors and said car door, said controller responding to said fault information representing an insubstantial gap by placing a service call without interrupting operation of the elevator system and representing a substantial gap by stopping operation of the elevator system and placing a service call.

7. The elevator system according to claim 6 wherein said controller further responds to said fault information representing a substantial gap by moving said elevator car at reduced speed to stop at a floor that can be reached without passing a shaft door having the substantial gap.

8. The elevator system according to claim 1 wherein said status detecting unit is mounted at said elevator car.

9. The elevator system according to claim 1 wherein said controller further responds to a presence of a fault in the region of said car door by performing a recovery attempt by automatic opening and closing of said car door.

10. The elevator system according to claim 1 wherein said controller further responds to a presence of a fault in the region of one of the shaft doors by moving said elevator car behind the one shaft door and performing a recovery attempt by opening and closing the one shaft door through automatic opening and closing of said car door.

11. An elevator system comprising:

an elevator car having a car door;

a drive unit connected to said elevator car for moving the elevator car (2; 12; 28) along an elevator shaft wall provided with shaft doors;

a controller connected to said drive unit for controlling movement of said elevator car along the elevator shaft wall;

a detecting means mounted in at least one of a region of each of the shaft doors and a region of said car door and being connected to said controller for generating fault information to said controller; and a status detecting unit connected to said controller for generating to said controller status information about a position and a speed of said elevator car whereby, in case of a fault in the region of one of the shaft doors, said controller moves said elevator car, after any passengers have disembarked, into a position directly behind the one shaft door in order to prevent a person from being able to fall through an open shaft door into said elevator shaft.

12. The elevator system according to claim 11 wherein said controller responds to said fault information representing a fault by placing a service call.

13. The elevator system according to claim 11 including a node connected to said detecting means and a bus connecting said node with said controller and wherein a signal representing a detected fault generated from said detecting means is processed by said node to generate said fault information.

14. The elevator system according to claim 11 including a safety bus connecting said controller to at least one of said detecting means and said status detecting unit.

15. The elevator system according to claim 11 wherein said fault information includes a state of an incorrectly closed one of the shaft doors and said car door, said controller responding to said fault information representing an insubstantial gap by placing a service call without interrupting operation of the elevator system and representing a substantial gap by stopping operation of the elevator system at that floor where the fault has occurred and placing a service call.

16. The elevator system according to claim 11 wherein said controller further responds to a presence of a fault in the region of said car door by performing a recovery attempt by automatic opening and closing of said car door.

17. An elevator system comprising:

an elevator car having a car door;

a drive unit connected to said elevator car for moving said elevator car along an elevator shaft wall provided with shaft doors;

a controller connected to said drive unit for controlling movement of said elevator car along the elevator shaft wall;

a detecting means mounted in at least one of a region of each of the shaft doors and in a region of said car door for generating fault information, said detecting means being connected to said controller for generating to said controller said fault information; and a status detecting unit connected to said controller for generating to said controller status information about a position and a speed of said elevator car whereby said detecting means ascertains whether a gap formed by an incorrectly closed one of the shaft doors or said car door is substantial or insubstantial, said controller responding to said fault information representing a presence of an insubstantial gap by moving said elevator car without restriction and placing a service call and said controller responding to said fault information representing a presence of a substantial gap at one of said shaft doors by moving said elevator car to a floor that can be reached without passing the one shaft door having the substantial gap in order to let passengers disembark.

18. The elevator system according to claim 17 including a node connected to said detecting means and a bus connecting said node with said controller and wherein a signal representing a detected fault generated from said detecting means is processed by said node to generate said fault information.

19. The elevator system according to claim 17 wherein said controller responds to said fault information representing a substantial gap by stopping operation of the elevator system at that floor where the fault has occurred and placing a service call.

20. The elevator system according to claim 17 wherein said controller further responds to said fault information by performing a recovery attempt by automatic opening and closing of said car door.

* * * * *